US006676506B2

(12) United States Patent
Steneby et al.

(10) Patent No.: US 6,676,506 B2
(45) Date of Patent: Jan. 13, 2004

(54) METHOD AND APPARATUS FOR VENTILATION OF FOUNDATIONS

(76) Inventors: Bengt Steneby, Fornfyndsvägen 14 A, Partille (SE), SE-433 41; Torsten Mattsson, Charles väg 16, Hovås (SE), SE-436 55

( * ) Notice: Subject to any disclaimer, the term of this patent is extended or adjusted under 35 U.S.C. 154(b) by 0 days.

(21) Appl. No.: 10/221,956

(22) PCT Filed: Mar. 19, 2001

(86) PCT No.: PCT/SE01/00567

§ 371 (c)(1),
(2), (4) Date: Sep. 18, 2002

(87) PCT Pub. No.: WO01/71102

PCT Pub. Date: Sep. 27, 2001

(65) Prior Publication Data

US 2003/0054753 A1 Mar. 20, 2003

(30) Foreign Application Priority Data

Mar. 23, 2000 (SE) ..... 0001028

(51) Int. Cl.[7] ..... F24F 7/007
(52) U.S. Cl. ..... 454/186
(58) Field of Search ..... 454/186–253

(56) References Cited

U.S. PATENT DOCUMENTS 4,843,786 A * 7/1989 Walkinshaw et al. ..... 52/169.5
5,345,779 A * 9/1994 Feeney ..... 62/259.2
5,468,184 A * 11/1995 Collier ..... 454/186
5,910,045 A * 6/1999 Aoki et al. ..... 454/186

FOREIGN PATENT DOCUMENTS

SE 170061 C 1/1960
SE 400362 B 3/1978
SE 507461 C2 6/1998

* cited by examiner

*Primary Examiner*—Gregory Wilson
(74) *Attorney, Agent, or Firm*—Sughrue Mion, PLLC

(57) ABSTRACT

Arrangement for protecting floors above the crawl space and buildings on foundations of the crawl-space type from damp and microbial growth, where the crawl space (2) is delimited by the floor (4) above the crawl space of the building, bearing foundation walls (1) with vents (9) for outdoor air and the foundation ground (3). The arrangement comprises an essentially windtight and vapourtight climate screen (12) which is arranged in such a manner that it divides the crawl space (2) into at least one upper (10) and at least one lower (11) climate zone and forms a tight partition between the climate zones. The climate screen (12) is located at such at height in the crawl space (2) that the outdoor air vents (9) in the foundation walls (1) communicate with only the lower climate zone (11). The upper climate zone (10) is provided with at least one supply air opening (18) which is connected to a room above in the building, and an exhaust air opening (21; 22) which is connected to a discharge duct (23; 24). A fan (25) is arranged in association with the discharge duct (23; 24), by means of which it is possible to maintain a lower pressure in the upper climate zone (10) than the pressure in said room above, so that the upper climate zone (10) is ventilated by indoor air from the building and the lower climate zone (11) is ventilated by outdoor air. The invention also relates to a method of protecting the floor above the crawl space from damp and microbial growth.

18 Claims, 17 Drawing Sheets

METHOD AND APPARATUS FOR VENTILATION OF FOUNDATIONS

FIELD OF THE INVENTION

The present invention relates to a method of protecting floors above the crawl space and buildings on foundations of the crawl-space type from damp and microbial growth, where the crawl space is delimited by the floor above the crawl space of the building, bearing foundation walls with vents for outdoor air and the foundation ground.

The invention also relates to an arrangement for use in application of the method.

BACKGROUND OF THE INVENTION

Building foundations of the crawl-space type, that is to say foundations where there is a crawl space between the floor of the building and the foundation ground, which crawl space is delimited in the lateral direction by bearing foundation walls, have traditionally been ventilated with outdoor air via vents located in the foundation walls. Foundations of this type have functioned well in the past, one of the reasons for which is the fact that chimneys extended through the floor above the crawl space and down into the crawl space, which thus contributed to warming and drying the foundation and the air therein. A certain degree of heat leakage down into the crawl space from rooms above also took place as a consequence of poor insulation of the floor above the crawl space. This, combined with correctly effected ventilation, meant it was possible to avoid problems of damp and mildew.

As crawl-space foundations ventilated by outdoor air constitute a cost-effective foundation method, this method was used during the second half of the twentieth century in the mass production of dwelling houses and also for other buildings, in particular prefabricated schools and the like.

In this connection, problems which are difficult to solve arose as a consequence of moisture deposition in the foundation, which gave rise to microbial growth, unpleasant smells and rot damage to the building.

The causes of these problems may be poor ground conditions combined with poorly executed foundation work. Other factors also have an effect, however, such as modern improved insulation materials which mean inter alia that thermal insulation of the floor structure is 5–6 times better compared with previously used sawdust-filled floor structures. Furthermore, there are not normally any heat-providing chimneys extending down into the crawl space.

REVIEW OF PRIOR ART

In order to cope with damp and mildew problems, many different solutions have been proposed with a view to improving and/or regulating the ventilation of foundation crawl spaces. Attempts have even been made to keep them dry by making the foundations as heated foundations. In this connection, the foundations were sealed and thermally insulated and also ventilated by means of indoor air or specifically heated air from the heated part of the building. Such foundations are relatively expensive, and the technique can be difficult to apply in existing buildings. As the whole foundation is to be ventilated by indoor air, very large air volumes also have to be handled. An example is disclosed in SE-C-170061. The prior art also includes the mounting of separate drying equipment in the crawl-space foundation.

Proposals exist in which this technique is combined with a method for bringing about warm floors, see for example SE-B-8007770-4. In this case, warm indoor air is conducted in a gap between the inner floor and the floor structure insulation before it passes down into the insulated foundation and is then drawn out. This method is difficult to use in existing buildings and does not eliminate the requirement for complete sealing and insulation of the entire crawl space. The necessity of handling very large volumes of heated indoor air also remains.

Common to many of the methods proposed today for improving the ventilation of crawl-space foundations is the attempt to turn the whole of the free crawl space into a climate-controlled zone in one way or another. This entails inter alia the abovementioned problem of having to handle very large air volumes. Furthermore, the foundations are usually constructed only with a view to static bearing capacity, which means that the tightness is in most cases very poor. In the laying of foundation walls made of foundation blocks, the butt joints are often entirely unfilled. Complete sealing of the whole crawl-space foundation is very difficult and costly to effect.

It has previously been proposed to divide the crawl space into different zones. SE-B-7511197-1 describes the use of a perforated air-distributing layer. The upper and lower zones therefore communicate with one another via the layer. In order to push air down into the lower zone, a higher pressure is used in the upper zone, which also means that air can be pushed back up into the building. Leaks often occur at pipe bushings and other connections, which make it virtually impossible to prevent the positive pressure in the foundation pushing possibly bad air from the foundation up into the building. If radon gas is present, this too will be pushed up into the building.

SE-C2-507461 also describes a foundation with a horizontal partition. This partition is intended to cause the ventilation air, which has been taken in via outdoor air vents, to flow along the lower surface of the floor structure, then to be drawn down into the foundation and discharged to the outside of the building. For the ventilation described, it is necessary for the entire foundation to be placed under negative pressure, which requires complete sealing of the whole foundation. This is not only costly but also very difficult. With outdoor air vents of this type, major problems also arise as a consequence of the positive or negative pressure the wind pressure brings about on the different sides of the building. With the construction disclosed, it is likely that there is a positive pressure in the foundation at least at times. The fan must nevertheless be dimensioned to handle very large quantities of air on account of inevitable leaks of the foundation wall also.

As the known construction uses outdoor air, this readily leads to condensate being deposited both in distribution ducts and on the screening panel. Even if warm indoor air from the building were used instead of outdoor air, condensate would be deposited, especially during the winter, when warm air, which can contain more moisture per unit of volume than cold air, is drawn down into the cold foundation, where moisture would then be precipitated.

The basis of the present invention is constituted by the knowledge that, for successful ventilation of crawl-space foundations, it is necessary to limit the volume of the foundation where the ventilation is to be monitored and controlled. This results in smaller quantities of air having to be handled and sealing of only a limited space being necessary, which is relatively easy to achieve compared with sealing an entire crawl-space foundation.

According to the present invention, this is achieved by virtue of the fact that the crawl space is divided into upper and lower climate zones, which are sealed in relation to one another by means of a tight climate screen. In this connection, the upper climate zone is flowed through by warm indoor air, which keeps this climate zone dry and well ventilated, which prevents moisture deposition and mildew attack on, for example, the floor above the crawl space. No regulation of the environment in the lower climate zone is then required, this zone being ventilated in a conventional manner by means of outdoor air vents in the surrounding foundation walls.

The particularly characteristic feature of a method of the type indicated in the first paragraph is then, according to the present invention, that the crawl space is divided into at least one upper and at least one lower climate zone, that the two climate zones are separated from one another by means of an essentially windtight and vapourtight climate screen which forms a tight partition between the climate zones, that the climate screen is arranged at such a height in the crawl space that the outdoor air vents in the foundation walls communicate with only the lower climate zone, that the upper climate zone is provided with at least one supply air opening and at least one exhaust air opening, that the supply air opening is connected to a room above in the building and the exhaust air opening is connected to a discharge duct, and that a fan is arranged in association with the discharge duct so as to maintain a lower pressure in the upper climate zone than the pressure in said room above, so that the upper climate zone is ventilated by indoor air from the building and the lower climate zone is ventilated by outdoor air.

If this method is applied, a dry and well ventilated space is obtained on the underside of the floor above the crawl space, which eliminates the risk of moisture deposition and mildew formation. As the volume of this space is relatively limited, it can be sealed easily, so that an effective negative pressure can be maintained in this zone. This prevents bad air, radon gas or the like being drawn up into the building above. The requirement for sealing the whole crawl space is also eliminated.

If necessary, the supply air opening can be provided with a connecting duct for supplying dried air from a drying apparatus.

It is preferred that the climate screen is thermally insulated so as to avoid any appreciable cooling of the ventilation air passing through the upper climate zone.

Other characteristics of this method and of an arrangement for use in application of the method emerge from the subsequent patent claims.

The invention will be described in greater detail below with reference to the embodiments shown by way of example in the accompanying drawings.

DETAILED DESCRIPTION OF PREFERRED EMBODIMENTS

Figure 1:
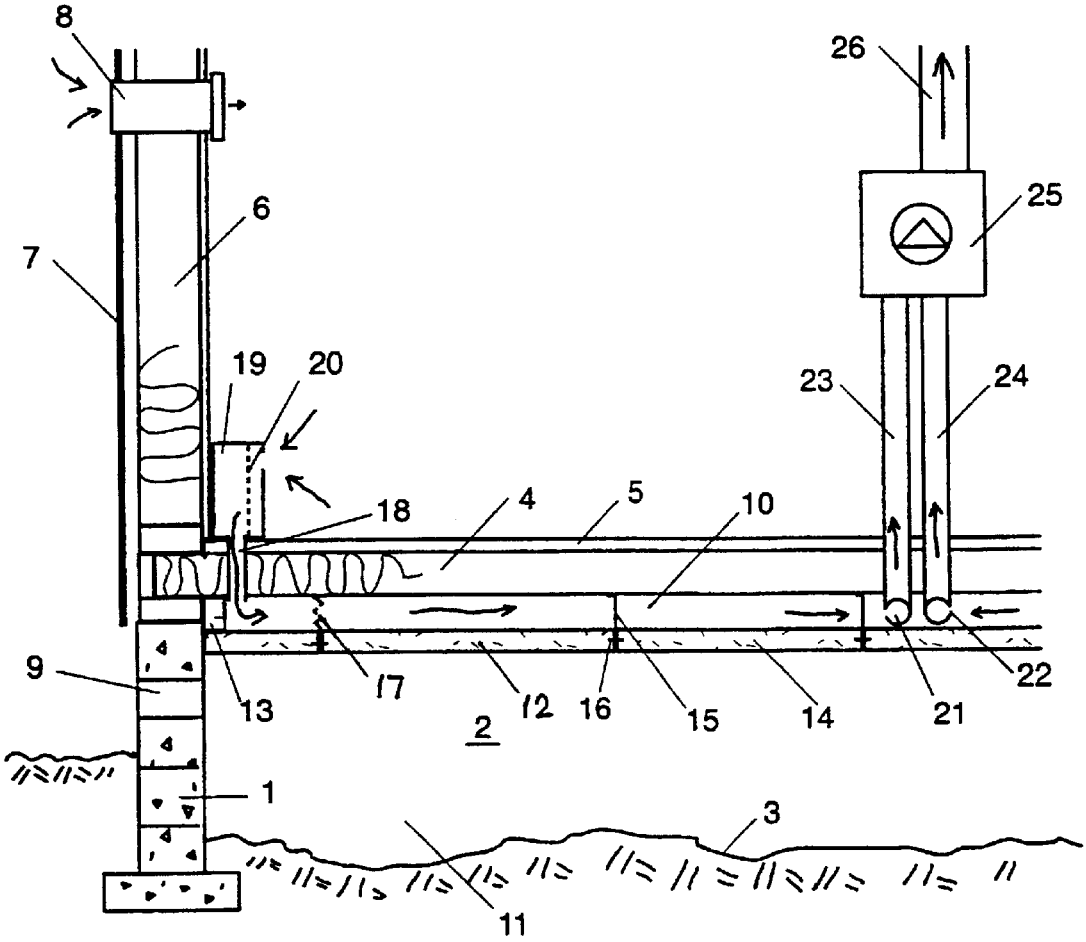
FIG. 1 shows diagrammatically a part of a building foundation of the crawl-space type equipped according to the present invention.

In FIG. 1, reference number 1 designates a bearing foundation wall of a building foundation of the crawl-space type. The crawl space 2 is also delimited by the foundation ground 3 and an insulated floor structure 4 above the crawl space with an inner floor 5. Reference number 6 designates one of the insulated outer walls of the building, reference number 7 relating to the outer panelling of the building.

The building obtains its supply air via one or more supply air vents 8 in the outer walls or alternatively from a conventional ventilation system. The crawl space 2 is ventilated via a number of outdoor air vents 9, suitably provided with netting, mounted in the foundation walls 1.

According to the present invention, in order to protect the floor structure 4 above the crawl space from damp and microbial growth, the crawl space 2 is divided into at least one upper climate zone 10 and at least one lower climate zone 11. The climate zones are separated by an essentially windtight and vapourtight climate screen 12 which is mounted essentially parallel to and at a relatively small distance from the underside of the floor structure 4 above the crawl space. The distance between the climate screen 12 and the floor structure 4 can be as small as 1–2 cm but is usually 5–6 cm. If it is desirable to build in other installations, such as for example waste pipes and the like, the distance can be 15–20 cm or greater. In any case, the volume of the upper climate zone 10 is considerably smaller than the volume of the lower climate zone 11.

As the climate screen 12 protects the floor structure 4 from the conditions in the lower climate zone 11, no special measures have to be taken with regard to the lower climate zone. This can therefore be ventilated in a conventional manner by means of the outdoor air vents 9 mounted in the foundation walls 1. This means that the climate screen 12 is always to be mounted at a higher level than the vents 9.

The upper climate zone 10 is to be sealed as well as possible against outdoor air. In this connection, the foundation walls 1 can be sealed over the part which delimits the climate zone 10 in the lateral direction. On account of the small height of the zone 10, this can be carried out effectively in a simple manner, for example by insertion of a sealing body 13 extending on all sides along the foundation walls 1.

In the embodiment shown in FIG. 1, the climate screen 12 is constructed from a number of insulating panels 14 joined together, which are suitably made of a rigid cellular plastic material, such as FRIGOLIT®. The panels 14 are suspended on swingable suspension elements 15 which bear mounting rails 16, as will be described in greater detail below. Reference number 17 designates an air-distributing means which will also be described in greater detail below.

In order to maintain a climate in terms of temperature and moisture in the upper climate zone 10 which prevents moisture deposition and microbial growth on inter alia the underside of the floor structure 4 above the crawl space, the climate zone 10 has supply openings 18 which are connected to supply air devices 19 with filters 20 in a room above in the building. Two such supply air openings 18 are suitably arranged on each of two of the opposite sides of the building, one or two exhaust openings 21, 22 being arranged essentially centrally in the building and each being connected to a discharge duct 23 and, respectively, 24. These can also be combined to form a common duct. If the building is long, an extra supply air opening 18 is arranged every 8–10 m of building length. The exhaust openings can consist of extraction pipes known per se with openings distributed along the pipe. In this connection, reference number 25 designates a suction fan connected to the ducts 23 and 24, with an outlet duct 26 which is suitably guided up above the ridge of the building. Supply air can be taken from any desired room in the building.

The fan 25 is adapted so as to maintain a lower pressure in the upper climate zone 10 than in the room above. This means that warm indoor air will be supplied to the climate zone 10 via the supply openings 18 and will flow along the underside of the floor structure 4 above the crawl space to the exhaust opening 21. As a result of the climate screen 12 being insulated, the air passing through the climate zone 10 will not be cooled to any appreciable extent during the cold time of the year either, for which reason no moisture deposition will take place. Radiant heat from the floor structure also contributes to this. In order that the airflow in the climate zone 10 is distributed over the entire width of the zone, an air-distributing means 17 is arranged between the climate screen 12 and the floor structure 4 above the crawl space, which distributes the airflow essentially uniformly or in another desired manner in the climate zone 10.

The arrangement described above can be used in order to improve existing foundations, as no measures are necessary in the building apart from the supply air device and the extraction fan. Sealing of the foundation walls is not critical as a small amount of outdoor air leaking in can be tolerated as a result of the small air volumes which have to be handled in this connection. The invention can of course also be used in the production of new buildings. The climate zone 10 can be divided into sections with separate supply and exhaust openings for individual climate control if so desired. The lower climate zone 11 can of course also be divided by further bearing walls or the like without functioning being affected.

The climate screen 12 can be varied depending on requirements and can consist of, besides tight cellular plastic panels, mineral wool panels, for example, if appropriate with a tight lower or upper surface layer. The screen can, depending on the outdoor climate, also be uninsulated and consist of a tensioned fabric. The panels 14 can be suspended from the floor structure 4, as shown, or be supported from below, for example, if this should prove to be suitable.

The supply air openings 18 can also be connected to, besides an optional air device 19, an air-conditioning system and/or air-drying equipment if so desired. This can be advantageous in, for example, buildings which are unheated for a certain part of the year.

Figure 2:
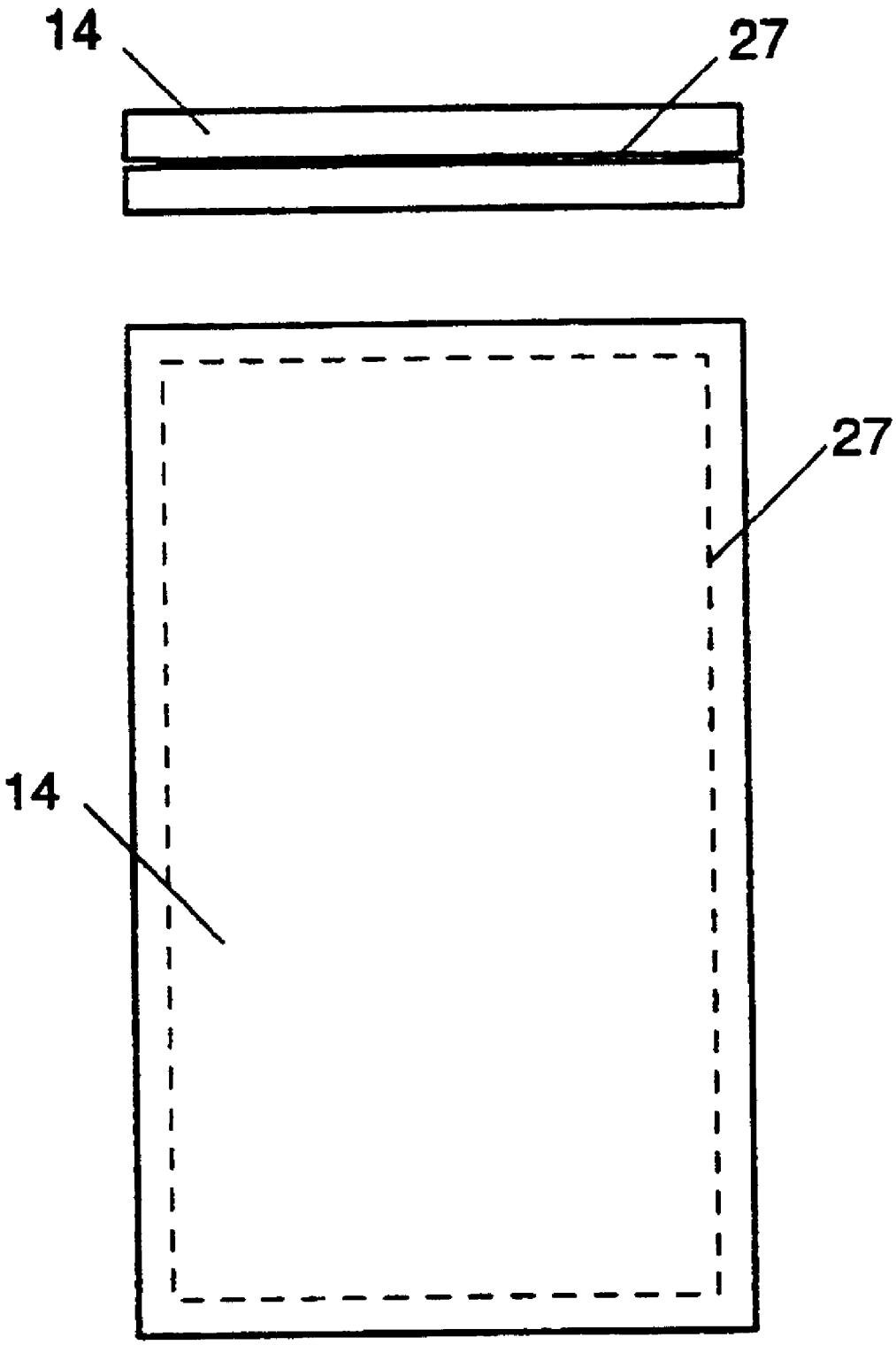
FIG. 2 shows a plan view and an end view of an insulating panel used in a climate screen according to FIG. 1.

FIG. 2 shows a cellular plastic panel 14 in a plan view and from one end. The panel is provided with a groove 27 extending on all sides.

Figure 3:
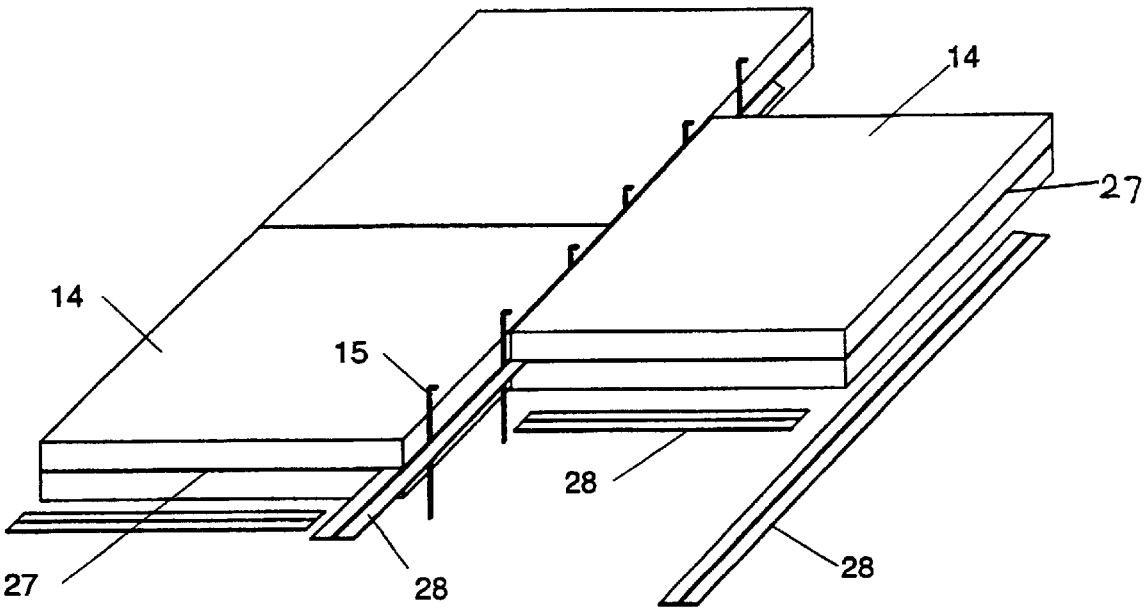
FIGS. 3–5 illustrate how the panel according to FIG. 2 can be mounted.

FIG. 3 shows how the grooves 27 are used, when adjacent panels are joined together, for receiving one half of a suspension and sealing rail 28 extending along the entire length or width of a panel. The other half of the rail is inserted into the groove in an adjacent panel 14. The rails 28 are provided with centrally located, slot-shaped openings through which swingable suspension elements 15 can be guided down and locked in the desired position.

In order to improve the retention of the rails 28 in the groove 27 of the panels, the rails can be made with longitudinal flanges which, in the event of an attempt to pull a rail out of a groove, are erected to perform a barb-like function.

The swingable suspension elements 15 are used, as can be seen from FIG. 4, for suspending the panels 14 below the floor structure 4 above the crawl space. In this connection, the suspension elements 15 are fastened to the floor above the crawl space, and the mounting and sealing rails 28 are secured on the suspension elements 15 in the desired position to form a climate zone 10 between the floor structure 4 and the panels 14 with the desired height. By virtue of the fact that the mounting rails 28 can be fastened at the desired height, the panels 14 can be mounted in the same plane irrespective of any inclination of the floor structure 4. The use of mounting rails 28 which are inserted into grooves 27 in the side edges of the panels 14 also means that small angular variations between the panels can be taken up, see FIG. 5, without the tightness between the panels being impaired. This can be further facilitated if the rails 28 are provided with a longitudinal groove 32, see FIG. 6, which can function as a hinge. Furthermore, the seal between the panels is not threatened in the event of limited movements of these as a result of shrinkage of the panel material or movements in the building. If so desired, however, an extra sealing strip 30 can be inserted in the joint between two adjacent panels.

Figure 4:
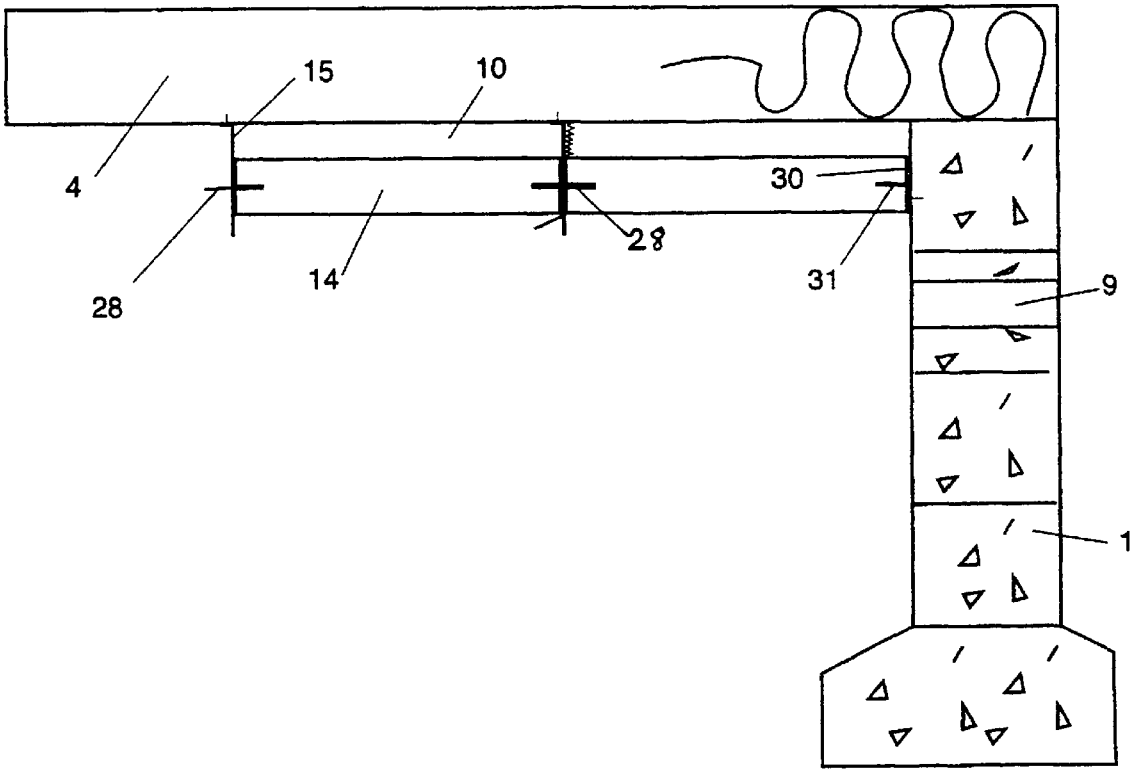
Figure 5:
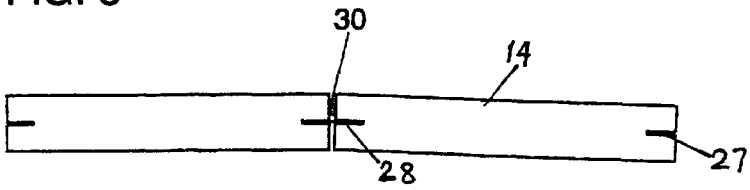

When the panels 14 are adjusted and mounted against the foundation wall 1, use can be made of a bent mounting rail 31, see FIG. 4. An extra sealing strip 30 can also be inserted here between the edge of the panel and the foundation wall if so desired.

Figure 6:
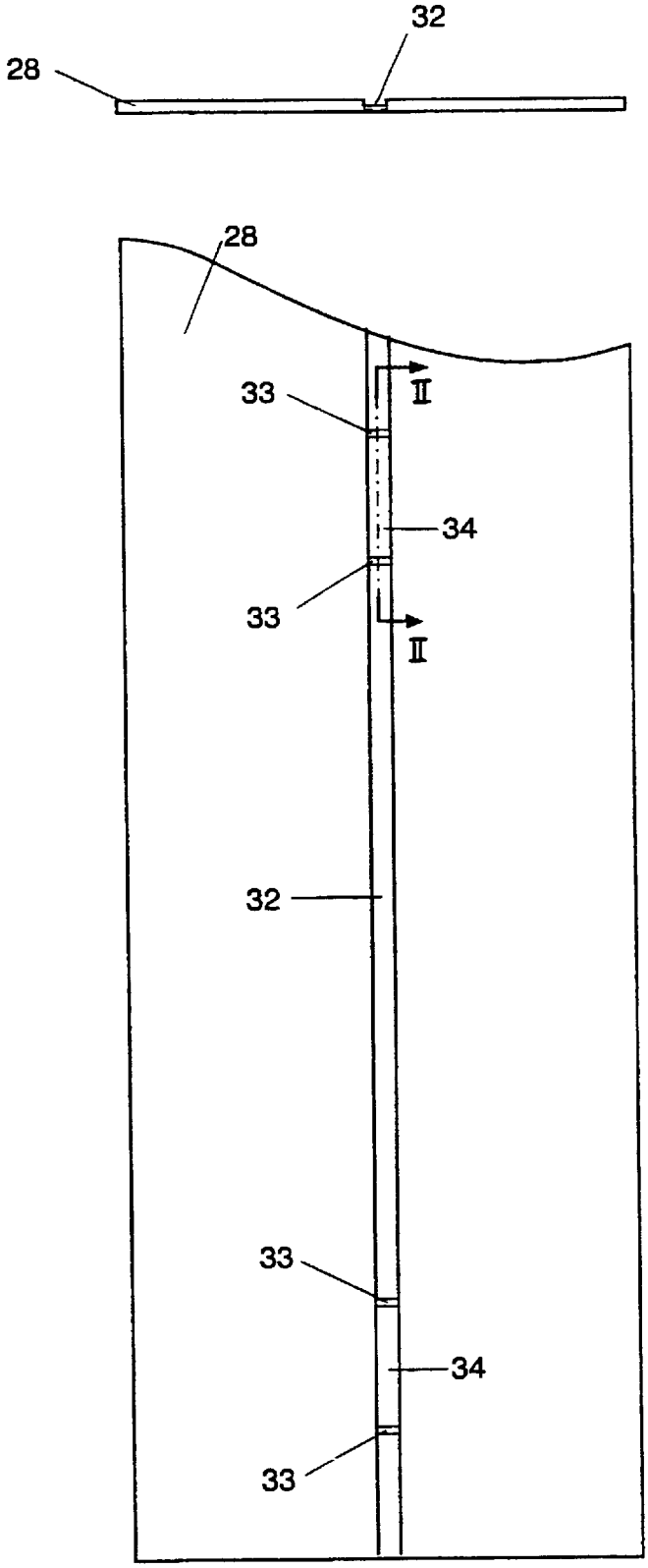
FIG. 6 shows a mounting rail used in FIG. 3, shown in a plan view and an end view.
Figure 6A:
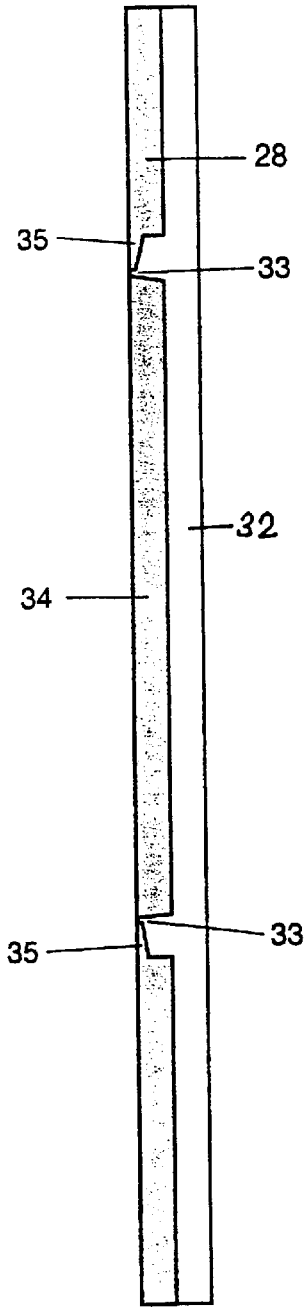
FIG. 6A is a sectional view along the line II—II in FIG. 6.

FIG. 6 shows a mounting and sealing rail 28 on larger scale. As can be seen from the end view, the strip is provided with a longitudinal groove 32 which is provided with predetermined break points 33, see the sectional view in FIG. 6A, in order to allow material portions 34 to be broken away to form slot-shaped openings in the rail 28. The transverse edges of the openings obtained will in this connection be formed by resilient tongues 35.

Figure 7:
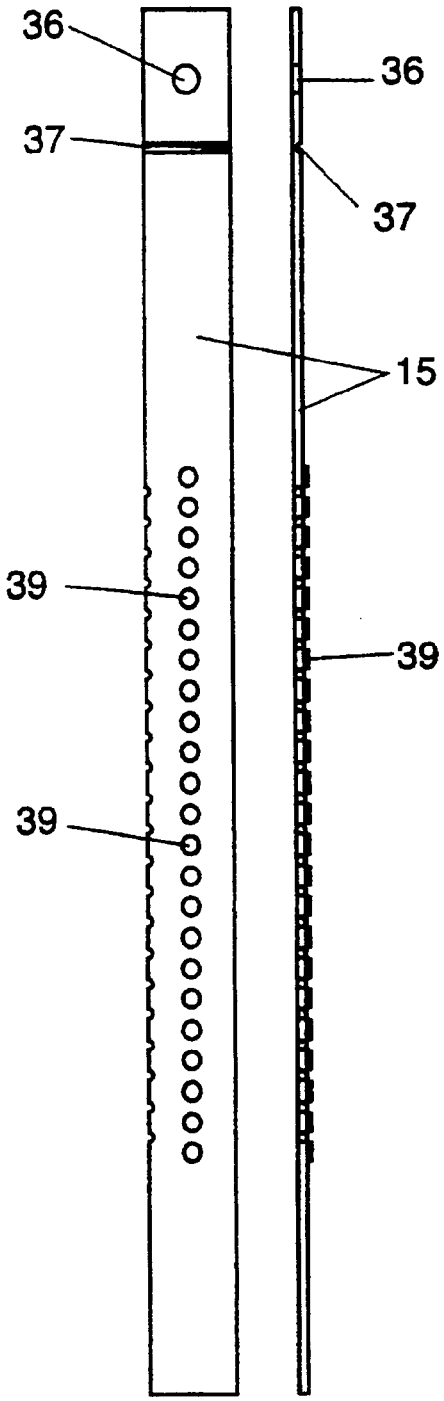
FIGS. 7 and 8 show a suspension element and, respectively, a wedge in a plan view and a side view, which are used for suspending the mounting rail according to FIG. 6.

FIG. 7 shows a swingable suspension element 15 seen from the front and from the side. The suspension element 15 is adapted so as to be fastened to a joist floor by screws or the like, which are guided through a hole 36 in the upper part of the suspension element, which is then angled into a position essentially at right angles relative to the remainder of the suspension element about a hinge axis 37. The width of the suspension element 15 is essentially the same as or slightly greater than the length of the slot-shaped openings in the rail 28, which are formed when the material portions 34 are broken away. At least one edge of the suspension element is toothed, which results in the resilient tongues 35 of the openings of the rail 28 holding the suspension element in position in the respective opening and providing resistance to the suspension element being displaced through the opening. On the front side, the suspension element has mutually separate projections 39.

Figure 8:
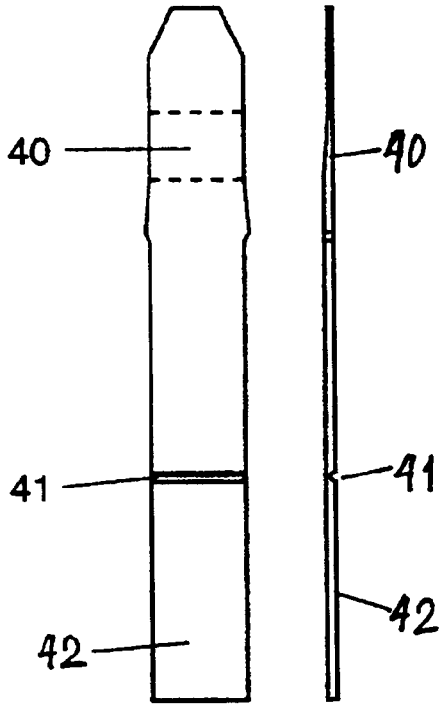

FIG. 8 shows a thin wedge 40 with a width essentially corresponding to the width of the suspension element 15. The wedge 40 is adapted so as to be inserted through an opening in the rail 28 together with the suspension element and on the plane side of the latter, when it has been decided at which height the rail 28 is to be fixed relative to the suspension element 15. The wedge 40 will then press the suspension element against one longitudinal edge of the slot in the rail, which edge then engages between two of the projections 39 in order to retain the rail 28 securely in the position taken up on the suspension element 15. However, the position can easily be adjusted subsequently by pulling the wedge 40 out, moving the rail 28 and reinserting the wedge. The lower portion 42 of the wedge 40 is hinged about an axis 41, which facilitates gripping the wedge after mounting.

Figure 9:
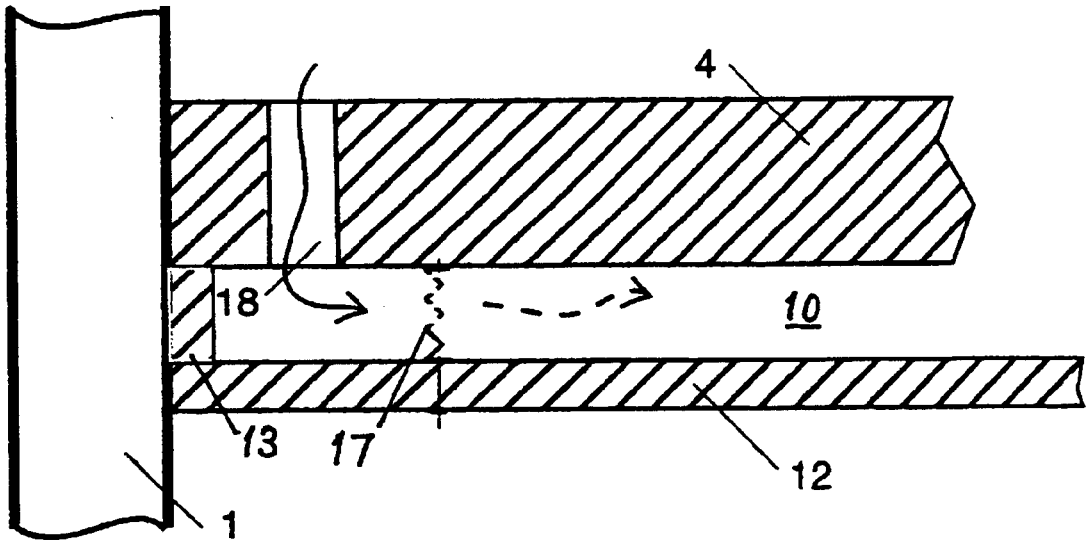
FIG. 9 illustrates the positioning of an air-distributing arrangement used according to the invention.

FIG. 9 shows how an air-diffusing divider 17 is fastened between the floor structure 4 and the climate screen 12 close to the inlet opening 18 to the climate zone 10. An embodiment of the air diffuser 17 is shown on larger scale in FIG. 10. This is provided with a number of openings or slots 29 which will distribute the airflow in a desired manner over the width of the climate zone. By virtue of the fact that the divider is bellows-shaped, it can be adapted to climate zones 10 of different or varying heights.

Figure 11:
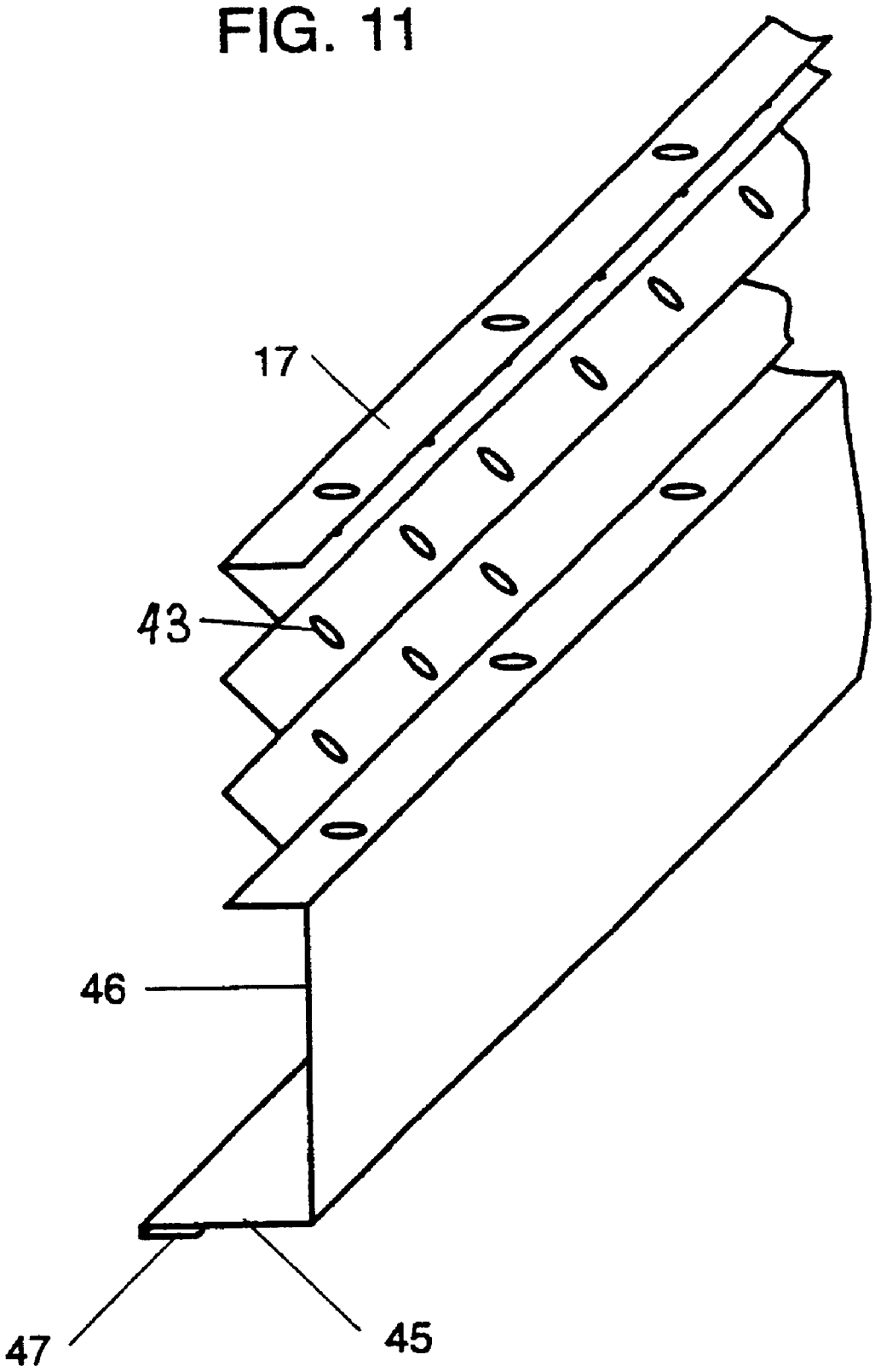

FIG. 11 shows an alternative embodiment, in which the divider 17 is perforated by holes 43 and has a lower flange 45 intended to be inserted into the groove in the edge of an insulating panel 14, according to FIG. 2, the upper part of the panel being received in the U-shaped profile 46. The flange 45 will be held pressed into the groove in the insulating panel 4 by means of the connecting and sealing rail 28 (FIG. 3) which is inserted into the space between the flange 45 and a folded-over portion 47 thereof.

Figure 12:
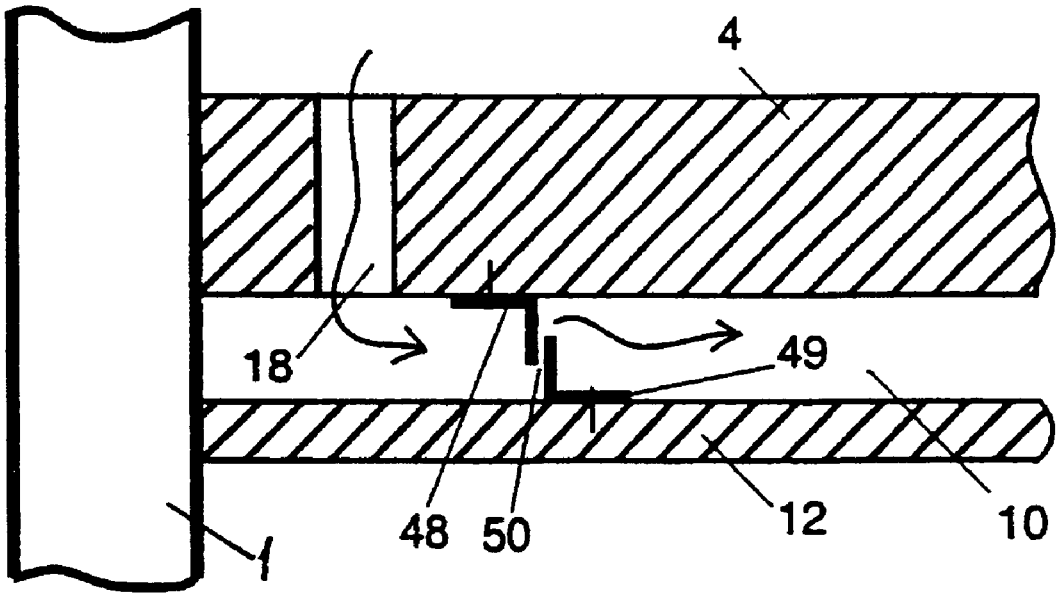
FIG. 12 shows a further embodiment of an air-distributing arrangement.

FIG. 12 shows a further embodiment of an air-distributing arrangement. In this case, it consists of two angled profiles 48, 49 which are fastened to the floor structure 4 above the crawl space and, respectively, the climate screen 12, so that a narrow gap 50 is formed between the profiles 48 and 49. By means of the gap 50, the airflow through the climate zone 10 can be made to spread out over the entire width of the zone.

Figure 10:
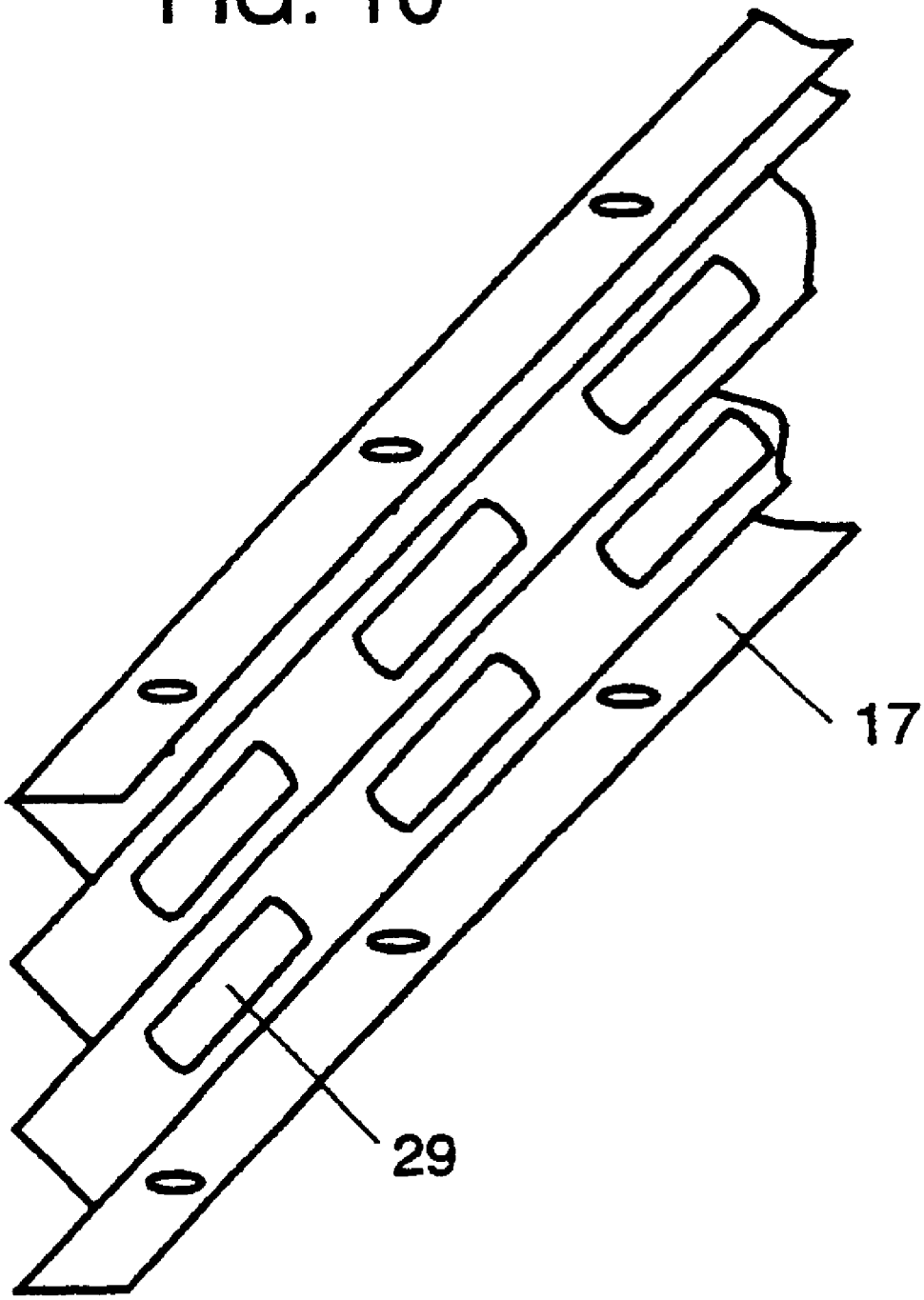
FIGS. 10 and 11 show two embodiments of an air-distributing arrangement according to FIG. 9.

By varying the hole distribution or the hole size over the dividers according to FIGS. 10 and 11 in the lateral direction, or changing the gap width 50 between the angled profiles 48 and 49 in the lateral direction in FIG. 12, the desired air distribution in the climate zone can be obtained.

The air-diffusing dividers according to FIGS. 10, 11 and 12 can also be used for delimiting different climate zones, in which case they are not provided with openings, or they are mounted in such a manner that an intermediate gap is not formed.

Figure 13:
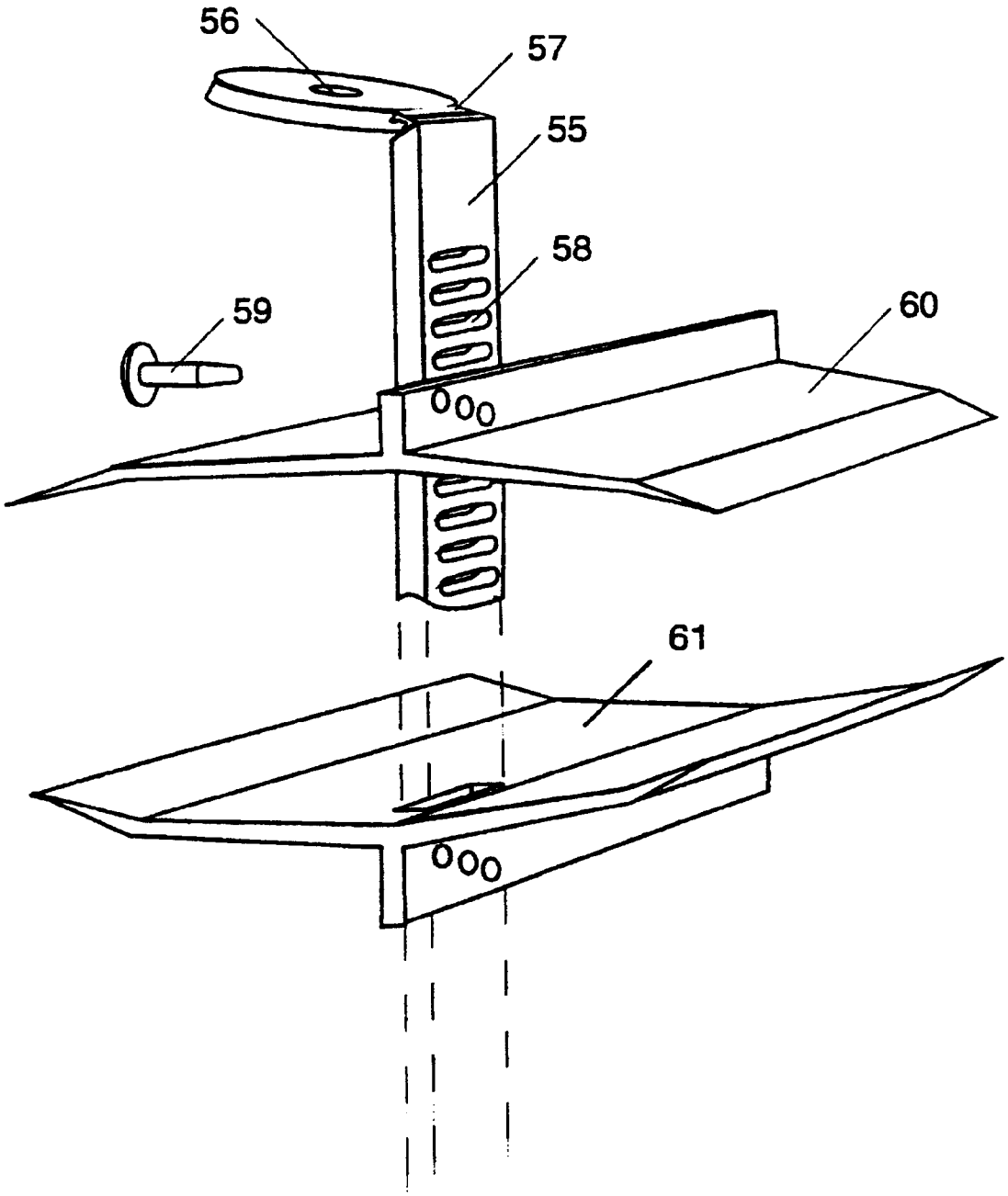
FIGS. 13 and 14 show an alternative mounting arrangement for insulating panels in a climate screen.

FIG. 13 shows an alternative embodiment of a suspension arrangement for insulating panels which are to form a climate screen 12 according to FIG. 1. The arrangement comprises a hanging swingable suspension element 55 which is connected to a fastening plate 56 via a hinge 57. The fastening plate 56 is intended to be mounted on the underside of the floor structure above the crawl space of the building. The suspension element is provided with a number of openings 58 for receiving mounting elements 59, by means of which an upper and a lower rail-shaped mounting and sealing profile 60 and, respectively, 61 can be mounted at the desired mutual distance. This distance is adapted to the insulating panel to be secured between the profiles.

Figure 14:
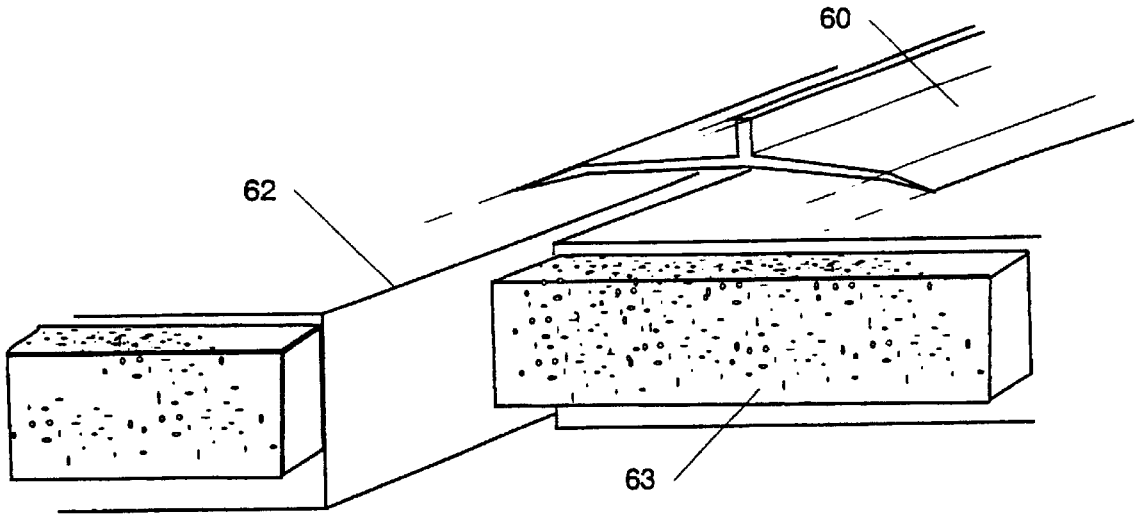

By means of this arrangement, the climate screen can also be constructed from softer insulating panels 62 made of, for example, mineral wool, see FIG. 14. Foamed plastic strips 63 can then be arranged in the butt joints between the mineral wool panels.

Figure 15:
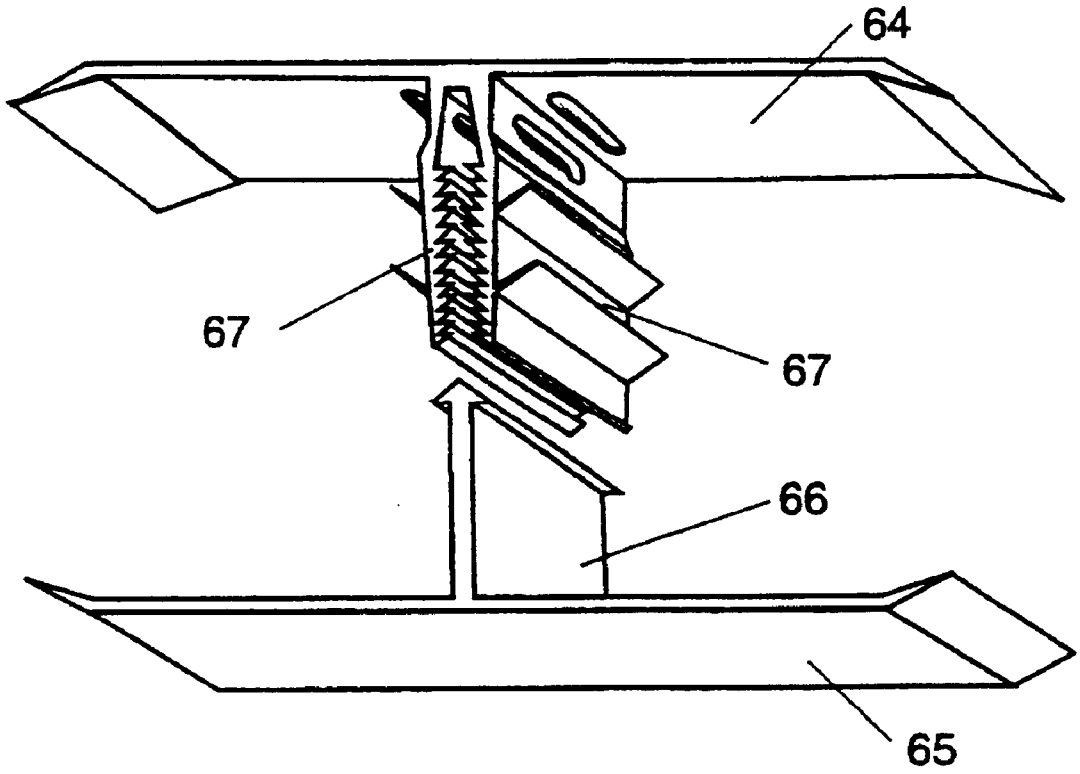
FIGS. 15 and 16 show two further embodiments of mounting arrangements for insulating panels.

FIG. 15 illustrates a further alternative suspension arrangement for insulating panels, which is also suitable for soft panels. It consists of an upper and a lower profiled rail 64 and, respectively, 65, one of which is provided with an upwardly projecting flange 66 which can be received in a gap between two downwardly projecting flanges 67, provided with friction teeth, of the other rail. The rails can thus be locked relative to one another at the desired mutual distance which is adapted to the thickness of the insulating panel to be used. Suspension is effected as previously by means of a swingable suspension element (not shown) which is fixed to the upper rail 64.

Figure 16:
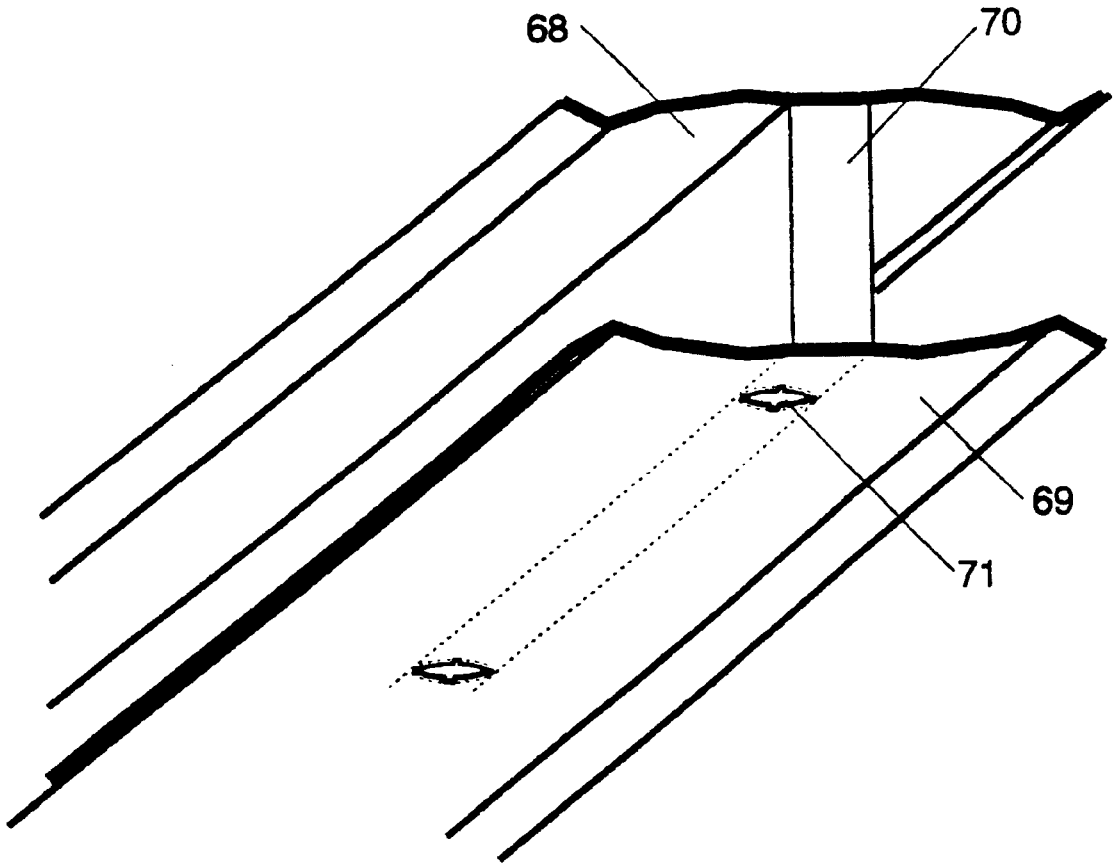

FIG. 16 shows a further alternative suspension arrangement which comprises upper and lower rails 68, 69 which are connected by means of a longitudinal cellular plastic core 70, the height of which is essentially the same as the thickness of the insulating panels to be used. Suspension from the floor structure is effected by means of height-adjustable screws which are guided through threaded holes 71 in the cellular plastic core 70.

Figure 17:
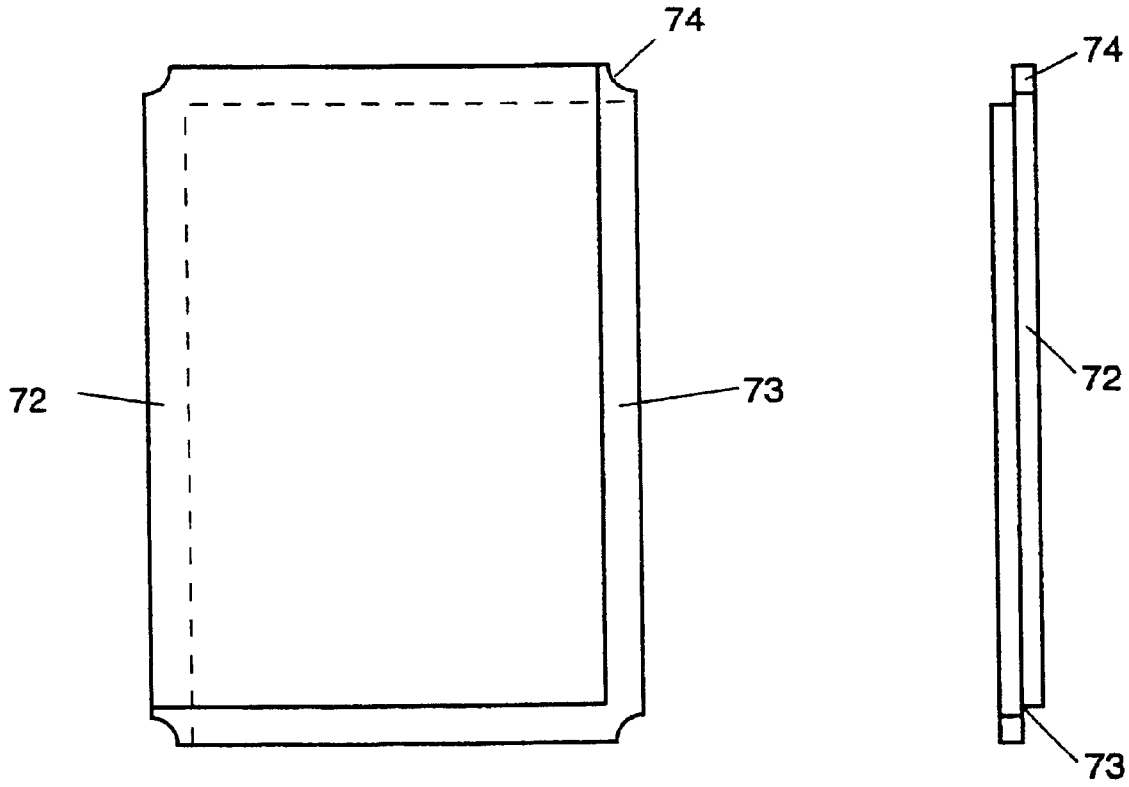
FIG. 17 shows a special embodiment of an insulating panel in a plan view and a side view.

FIG. 17 shows a specially shaped insulating panel 72 with milled-out edge portions 73 along two adjacent edges on one side and along the other two edges on the other side of the panel. The panels have rounded cutouts 74 at the corners.

Figure 18:
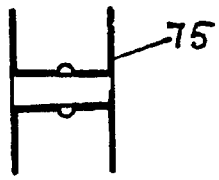
FIG. 18 is a mounting element for a panel according to FIG. 17.

Mounting of the panels is effected by means of bobbin-like mounting elements 75, see FIG. 18, which are suspended, by means of height-adjustable screws, from the floor structure of the building in positions for the rounded corner portions of the panels 72.

Figure 19:
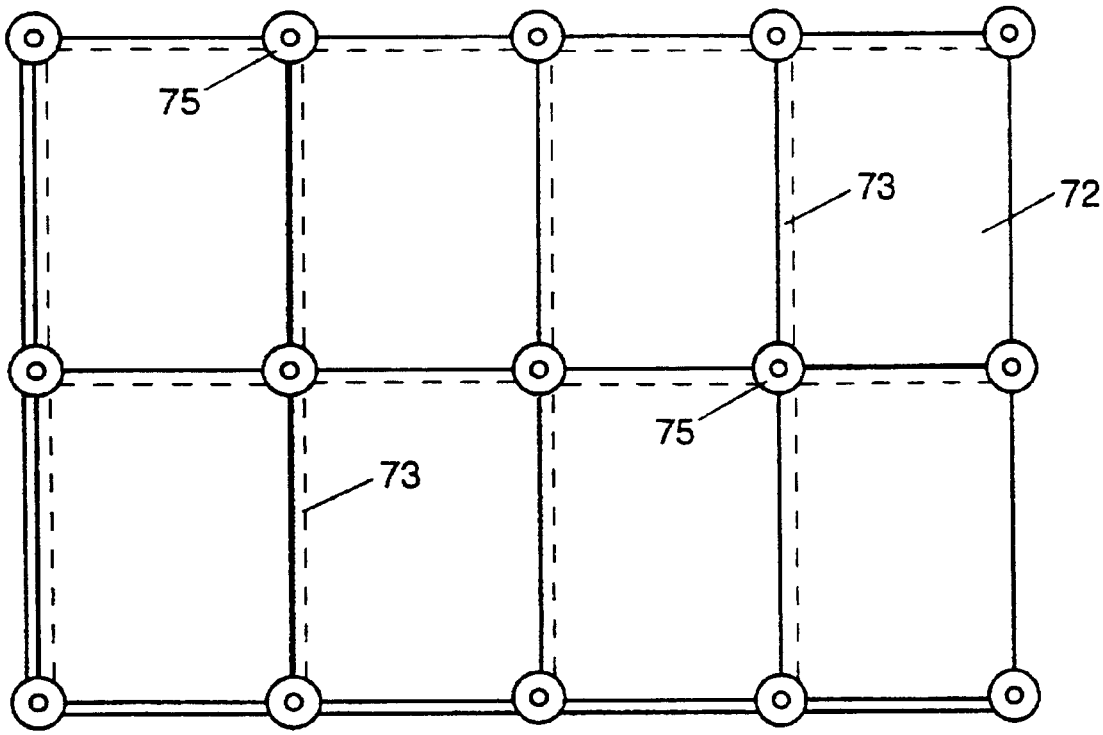
FIG. 19 illustrates a number of insulating panels according to FIG. 17 mounted as a climate screen.

FIG. 19 shows a section of a climate screen constructed in this manner, consisting of panels 72 supported by mounting elements 75, and forming a completely tight screen as a consequence of the overlaps between the milled-out edge portions 73 of adjacent panels.

Figure 20:
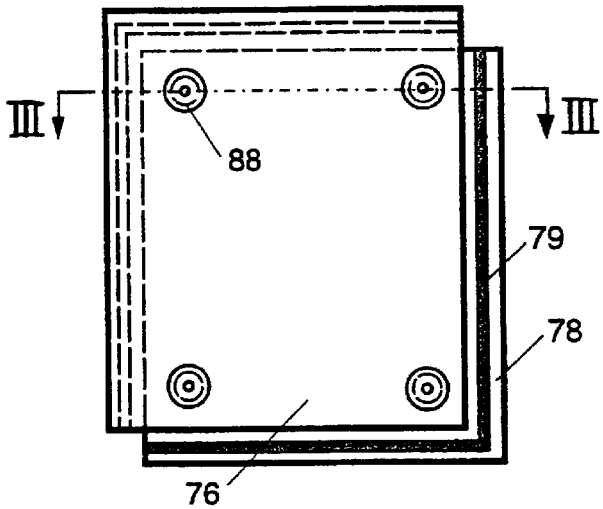
FIGS. 20 and 21 illustrate a further embodiment of an insulating panel according to the invention.
Figure 21:
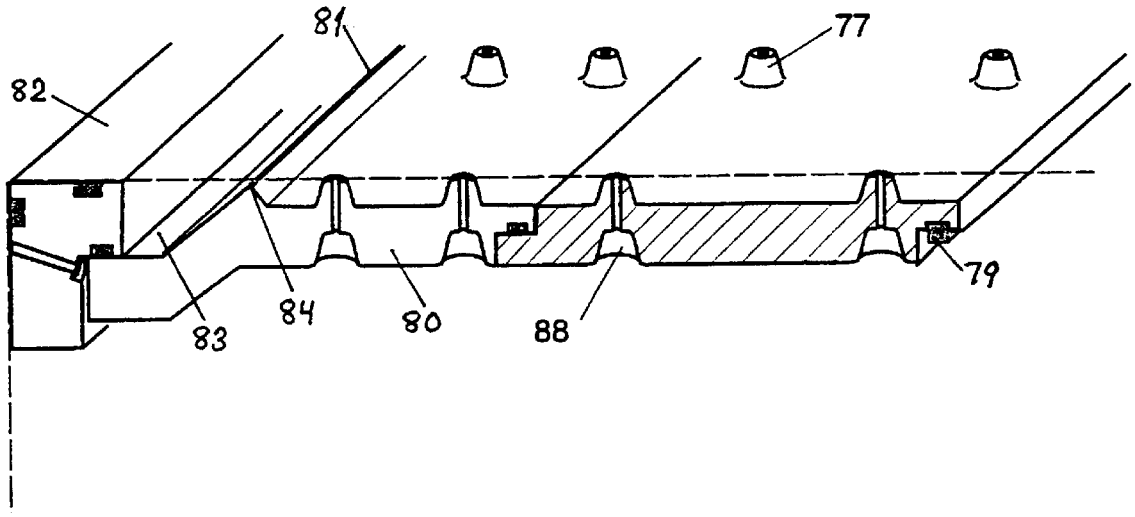

FIGS. 20 and 21 show a specially manufactured insulating panel 76 which is made in such a manner that, when it is mounted on the underside of a floor structure, a delimited climate zone is formed between the panels and the floor structure as a result of the panels being formed with distance means 77. These panels are also provided with milled-out edge portions so as to overlap one another on mounting according to FIG. 20. In this connection, the side flanges 78 can be provided with sealing strips 79. The undersides of the panels are made with recesses 88 which correspond to the distance means 77 in order to allow volume-effective stacking of panels one on another during transport and storage.

On mounting according to FIG. 21, use is also made of special air-distributing panels 80 which are made with a longitudinal ridge 81 which, together with an edge profile 82, delimits a horizontal duct 83 for supply air and, in interaction with the floor structure above, forms an air-distributing gap 84.

It is common to all the mounting systems described above for panels which are to form a climate screen that the panels can be mounted easily from below on a floor structure above the crawl space. Furthermore, after mounting, the panels cannot fall down into the lower climate zone or be drawn up into the upper climate zone as a consequence of the negative pressure prevailing therein.

The invention has been exemplified above in connection with some embodiments shown in the drawings. However, as the person skilled in the art will understand, these can be varied in a number of respects within the scope of the patent claims.

What is claimed is:

1. Method of protecting floors above the crawl space and buildings on foundations of the crawl-space type from damp and microbial growth, where the crawl space (2) is delimited by the floor (4) above the crawl space of the building, bearing foundation walls (1) with vents (9) for outdoor air and the foundation ground (3), characterized in that the crawl space (2) is divided into at least one upper (10) and at least one lower (11) climate zone, in that the two climate zones are separated from one another by means of an essentially windtight and vapourtight climate screen (12) which forms a tight partition between the climate zones, in that the climate screen (12) is arranged at such a height in the crawl space (2) that the outdoor air vents (9) in the foundation walls (1) communicate with only the lower climate zone (11), in that the upper climate zone (10) is provided with at least one supply air opening (18) and at least one exhaust air opening (21; 22), in that the supply air opening (18) is connected to a room above in the building and the exhaust air opening (21; 22) is connected to a discharge duct (23; 24), and in that a fan (25) is arranged in association with the discharge duct so as to maintain a lower pressure in the upper climate zone (10) than the pressure in said room above, so that the upper climate zone (10) is ventilated by indoor air from the building and the lower climate zone (11) is ventilated by outdoor air.

2. Method according to claim 1, characterized in that the supply air opening (18) is provided with a connecting duct which can supply dried air from a drying apparatus.

3. Method according to claim 1, characterized in that the part of the foundation wall (1) which delimits the upper climate zone (10) is sealed, so that good tightness against outdoor air being drawn into the upper climate zone is achieved.

4. Method according to claim 1, characterized in that use is made of a thermally insulated climate screen.

5. Method according to claim 1, characterized in that the climate screen (12) is positioned at such a height that the upper climate zone (10) has a considerably smaller volume than the lower climate zone (11).

6. Method according to claim 1, characterized in that the upper climate zone (10) is divided into a number of sections which are ventilated separately.

7. Method according to claim 1, characterized in that air-diffusing means (17) are arranged after the supply opening (18) in the upper climate zone (10).

8. Arrangement for protecting floors above the crawl space and buildings on foundations of the crawl-space type from damp and microbial growth, where the crawl space (2) is delimited by the floor (4) above the crawl space of the building, bearing foundation walls (1) with vents (9) for outdoor air and the foundation ground (3), characterized in that it comprises an essentially windtight and vapourtight climate screen (12), in that the climate screen is arranged in such a manner that it divides the crawl space (2) into at least one upper (10) and at least one lower (11) climate zone and forms a tight partition between the climate zones, in that the climate screen (12) is located at such a height in the crawl space (2) that the outdoor air vents (9) in the foundation walls (1) communicate with only the lower climate zone (11), in that the upper climate zone (10) is provided with at least one supply air opening (18) which is connected to a room above in the building, and an exhaust air opening (21; 22) which is connected to a discharge duct (23; 24), and in that a fan (25) is arranged in association with the discharge duct (23; 24), by means of which it is possible to maintain a lower pressure in the upper climate zone (10) than the pressure in said room above, so that the upper climate zone (10) is ventilated by indoor air from the building and the lower climate zone (11) is ventilated by outdoor air.

9. Arrangement according to claim 8, characterized in that it comprises an air-drying apparatus which can supply dried air to said supply air opening (18).

10. Arrangement according to claim 8, characterized in that a seal (13) is provided, which seals that part of the foundation wall (1) which delimits the upper climate zone (10) in order to render it difficult for outdoor air to be drawn into the upper climate zone.

11. Arrangement according to claim 8, characterized in that the climate screen (12) is thermally insulated.

12. Arrangement according to claim 8, characterized in that the climate screen (12) is located at such a height that the upper climate zone (10) has a considerably smaller volume than the lower climate zone (11).

13. Arrangement according to claim 8, characterized in that the upper climate zone (10) is divided into a number or sections which are provided with separate supply and exhaust openings.

14. Arrangement according to claim 8, characterized in that air-diffusing means (17) are arranged after the supply opening (18) in the upper climate zone (10).

15. Arrangement according to claim 14, characterized in that said air-diffusing means (17) comprise dividers (17) with flow-controlling openings (29; 42) mounted between the floor (4) above the crawl space and the climate screen (12).

16. Arrangement according to claim 15, characterized in that the dividers (17) are bellows-shaped so as to be capable of being adapted to different heights of the climate zone (10).

17. Arrangement according to claim 8, characterized in that the climate screen (12) consists of a number of panel sections (14) with grooves (27) extending on all sides, in that adjoining panel sections are connected by means of a rail (28) inserted into corresponding grooves in the panel sections (14), and in that these rails are suspended on suspension elements (15) hanging down from the floor (4) above the crawl space.

18. Arrangement according to claim 17, characterized in that said rail (28) is made with indications (33) for making openings therein, in that the openings are adapted so as to be capable of receiving said suspension elements (15), and in that the arrangement comprises wedge means (40) which can be inserted into the openings for securing the rail (28) at the desired height along the respective suspension element (15).

* * * * *